US005357634A

United States Patent [19]

Aoki

[11] Patent Number: 5,357,634

[45] Date of Patent: Oct. 25, 1994

[54] WEBBING FOR SPORTS GLOVE

[75] Inventor: Akio Aoki, Osaka, Japan

[73] Assignee: Trion Corporation, Osaka, Japan

[21] Appl. No.: 188,074

[22] Filed: Jan. 27, 1994

[51] Int. Cl.[5] ..... A41D 13/08

[52] U.S. Cl. ..... 2/19; 2/161.1

[58] Field of Search ..... 2/19, 16, 161.1, 159; D2/361

[56] References Cited

U.S. PATENT DOCUMENTS

| | | | |
|---|---|---|---|
| D. 211,848 | 8/1968 | Khazzam | 2/19 X |
| D. 213,284 | 2/1969 | Khazzam | 2/19 X |
| 3,321,771 | 5/1967 | Latina | 2/19 |
| 4,541,126 | 9/1985 | Howard et al. | 2/19 |
| 4,720,875 | 1/1988 | Latina et al. | 2/19 |
| 4,908,880 | 3/1990 | Clevenhagen | 2/19 |

*Primary Examiner*—Clifford D. Crowder
*Assistant Examiner*—Larry D. Worrell, Jr.
*Attorney, Agent, or Firm*—Webb Ziesenheim Bruening Logsdon Orkin & Hanson

[57] ABSTRACT

A webbing for a ball-catching glove having separate protective coverings for the thumb and forefinger between which the webbing is laced comprises a center web of flexible sheet material, a plurality of folding links of flexible sheet material, one of each links being partially fitted through a link hole in the center web and folded and an edge piece comprising flexible sheet material with a plurality of tabs extending therefrom, each tab being fitted into link holes of one of the plurality of folding links and being folded back along a fold line onto the edge piece and stitched thereto.

15 Claims, 4 Drawing Sheets

WEBBING FOR SPORTS GLOVE

FIELD OF THE INVENTION

This invention relates to the construction of sports gloves and in particular the webbing laced between the padded thumb and padded forefinger of a baseball or softball glove or mitt.

BACKGROUND OF THE INVENTION

Baseball or softball gloves or mitts have a webbing into which balls are captured. The webbing must absorb a portion of the energy of the ball when struck by the ball so that the player wearing the glove can close the glove around the ball before it pops out again.

The webbing for a baseball or softball glove must be capable of effectively relieving the ball-catching shock and damping the bounce of the ball as it strikes the webbing. If properly designed, the webbing wraps around the ball and pulls the glove closed when the ball strikes the webbing. The trajectory of the ball as it enters the glove is not necessarily a straight line as when the ball is breaking due to rotation placed on the ball by contact with the bat. The spin on such balls makes the capture in the glove more difficult. The webbing of the glove must enable reliable capture of the ball even if there is an unusual spin on the ball.

It is an object, according to this invention, to provide a webbing for a baseball glove which provides the damping characteristic required to reliably capture baseballs and softballs in spite of the spin upon the ball.

It is a further object, according to this invention, to provide a novel construction of a webbing for a baseball glove which is constructed of flexible sheet material and in which leather thongs are only used, if at all, to lace the webbing in place between the padded thumb and forefinger of the glove or mitt.

SUMMARY OF THE INVENTION

Briefly, according to this invention, there is provided a webbing for a ball catching glove having separate protective coverings for the thumb and forefinger between which the webbing is laced. The webbing comprises a center web fabricated of flexible sheet material. The center web has an outer edge defining the shape thereof. There are a plurality of link holes through the center web spaced along the outer edge of the center web. A plurality of folding links fabricated of flexible sheet material have an outer edge defining the shape of the link. The shape of the folding links is substantially symmetrical about a fold line with link holes on opposite sides of the fold line. The link holes are positioned to align when the folding link is folded along the fold line. One folding link is partially fitted through each link hole in the center web and folded so that its link holes align. There is also an edge piece forming a frame for the webbing. The edge piece is formed of flexible sheet material having an outer edge defining a rim and an inner edge with a plurality of tabs extending therefrom. Each tab is fitted into the aligned link holes of one of the plurality of folding links and is folded back along a fold line onto the edge piece and stitched thereto. A plurality of small holes along the outer edge of the edge piece enable lacing of the edge piece to the glove.

According to one embodiment of this invention, the edge piece encloses the center web and is fastened thereto by stitching at at least one location and by folding links at other locations. In this embodiment, the webbing has an edge piece which comprises a U-shaped section with a crossbar closing off the U-shaped section and the center web is stitched to the bottom of the U-shaped section and to the crossbar. In this embodiment, the center web may have a substantially rectangular shape with link holes along two opposite outer edges and is fastened to the edge piece by stitching along the other two opposite outer edges.

According to another embodiment of this invention, the edge piece encloses the center web and is fastened thereto only by folding links. In this embodiment, the center web may have a substantially circular outer edge with a central opening therein.

Preferably, the center web comprises layers of flexible sheet material stitched together face-to-face and the edge piece comprises flexible sheet material folded and stitched together. The edge piece is slit to form a plurality of tabs for engaging the folding links.

Preferably, each of the link holes in the center web has a straight edge which is substantially parallel to the edge of the center webb and which is in contact with the fold line of a folding link. Also, preferably, each of the link holes in the folding links has a straight edge which is substantially parallel to the fold line of the folding link and which is in contact with the fold line of a tab on the edge piece.

According to one embodiment, the folding links are narrowed along the fold line and also so are the tabs on the edge piece. The link holes in the center web must be large enough for the folding links to be rolled and inserted partially therethrough and the width of the links at the folding line are preferably just less than the width of the link holes in the center web. Also, the link holes in the folding links must be large enough for the tabs on the edge piece to be rolled and inserted partially therethrough and the width of the tabs at the folding line are preferably just less than the width of the link holes in the folding links.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

Figure 1:
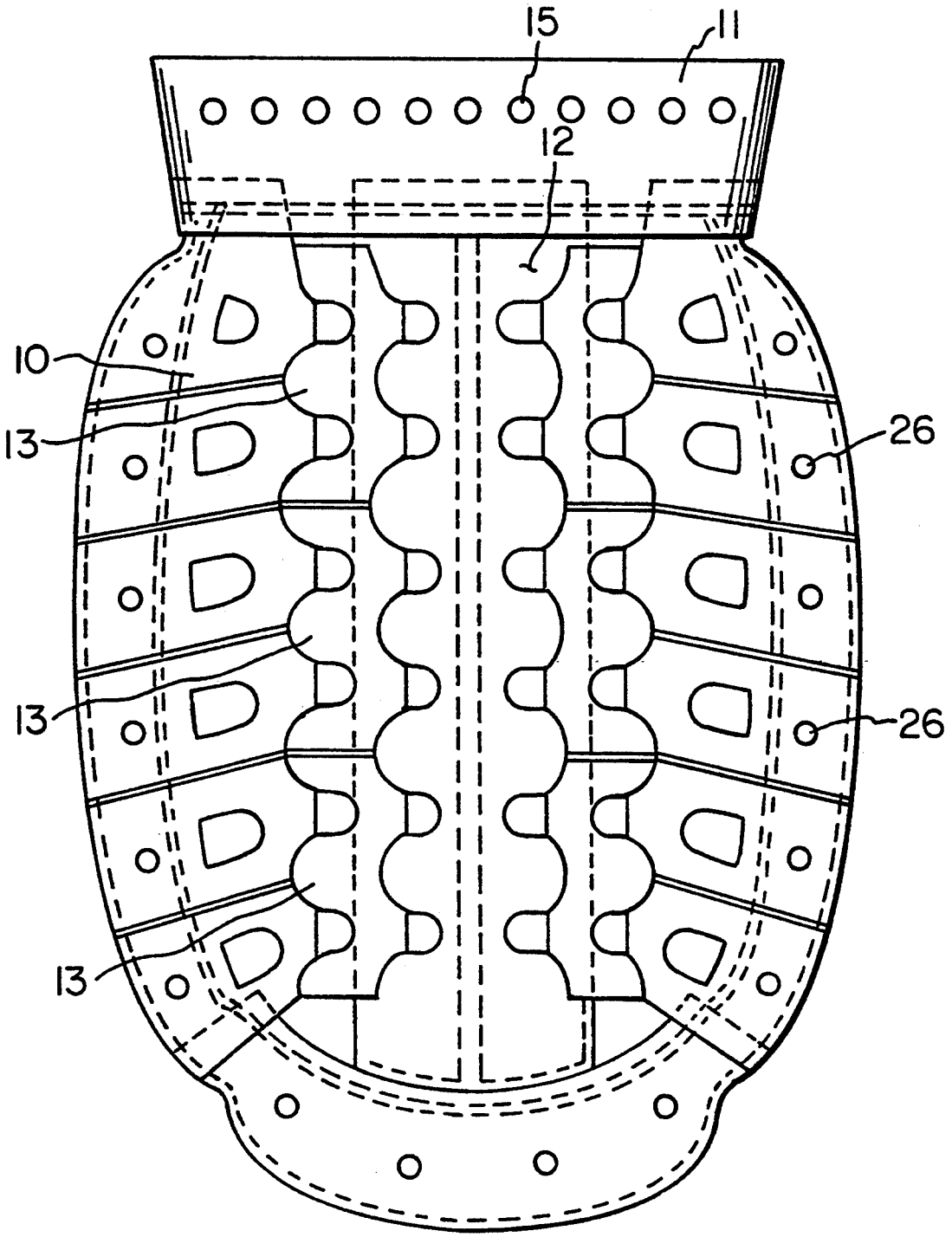
FIG. 1 is a plan view of a first embodiment according to this invention wherein the center web is joined to the frame by both stitching and folding links.

Referring to FIG. 1, a webbing according to one embodiment of this invention is shown as assembled and ready to be laced into the crotch between the padded thumb and forefinger of a baseball glove. An edge piece 10 in the form in a U-shape is configured to fit within the crotch. A crossbar 11 closes off the top of the U-shaped edge piece. Extending between the crossbar and the bottom of the U-shaped edge piece is the center web 12. The center webb 12 is stitched to the crossbar 11 and the edge piece at the top and bottom as shown in the drawing. The center web 12 is also secured to the edge piece 10 by a plurality of folding links 13. The edge piece, crossbar, center web and folding links are all formed of flexible sheet material such a leather.

The crossbar 11 comprises a single piece of sheet material that has been folded over along the top edge and stitched together along the lower edge. Across the top edge of the crossbar is a plurality of holes 15 for receiving a leather thong or the like for anchoring the webbing between the thumb and forefinger of the glove.

Figure 3:
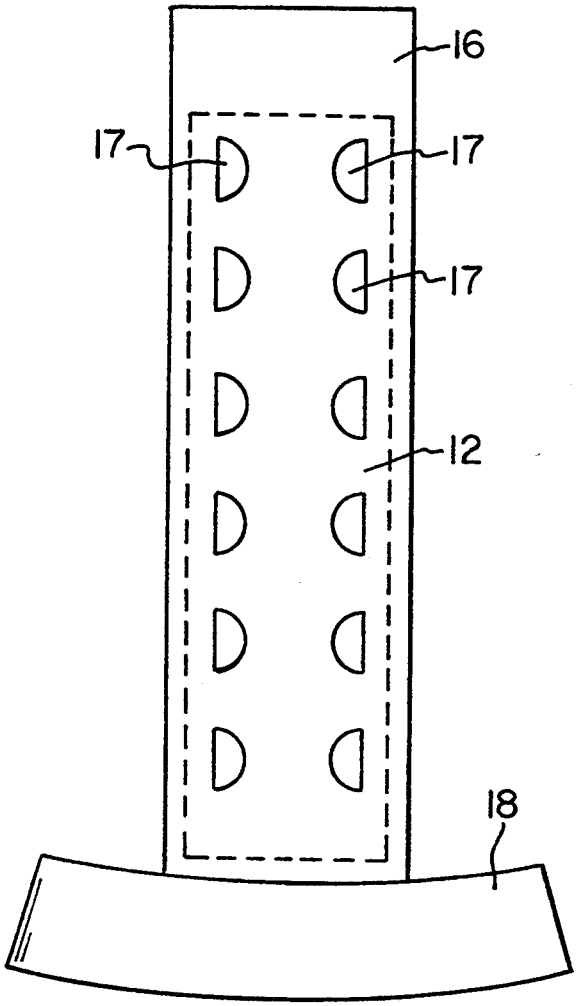
FIG. 3 is plan view of a center web according to the first embodiment.

Referring now to FIG. 3, there is shown the center web 12 separated from the remaining elements of the webbing. The center web is made of at least two layers of flexible sheet material sewn face-to-face along the outer edge thereof. At the upper end there is a large tab 16 that upon assembly is inserted between the fold of the crossbar and secured by the stitching along the bottom of the crossbar. A plurality of equally spaced openings or cutouts 17 for receiving folding links are cut through both layers of the center web. The openings must be large enough so that the folding links can be inserted therein. Most preferably, the openings have a straight edge that is parallel to the edge of the center web. In this way, the folding links will maintain maximum contact with the edge of the openings thus evenly distributing force from the center web to the folding links and vice versa. One of the layers comprising the center web may be integrally connected to a portion 18 of the edge piece.

Figure 4:
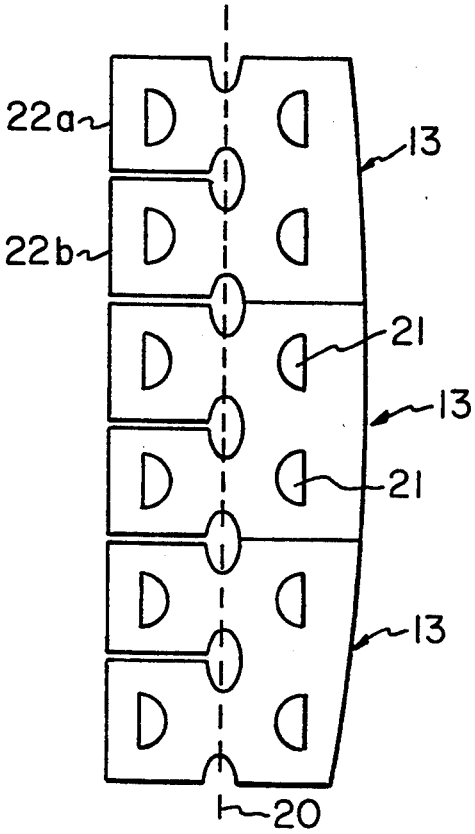
FIG. 4 is a plan view of three duplex folding links according to any embodiment of this invention.

Referring now to FIG. 4, there are shown unfolded cut pieces for three folding links 13. The folding links are symmetrical about a fold line indicated on the drawing by a dashed line 20. The folding links have link holes 21 that align when the links are folded along the fold line. The link holes have a straight edge parallel to the fold line. The link holes are large enough so that tabs on the edge pieces 10 can be inserted partially therethrough. As shown in the drawing, each folding link has two tabs *22a, 22b* associated therewith. It would be satisfactory to cut each folding link in half in which case each link would comprise one tab. There are advantages to the double tab folding link structure shown for the three links in FIG. 4; namely, increasing the stiffness of the webbing.

Figure 5:
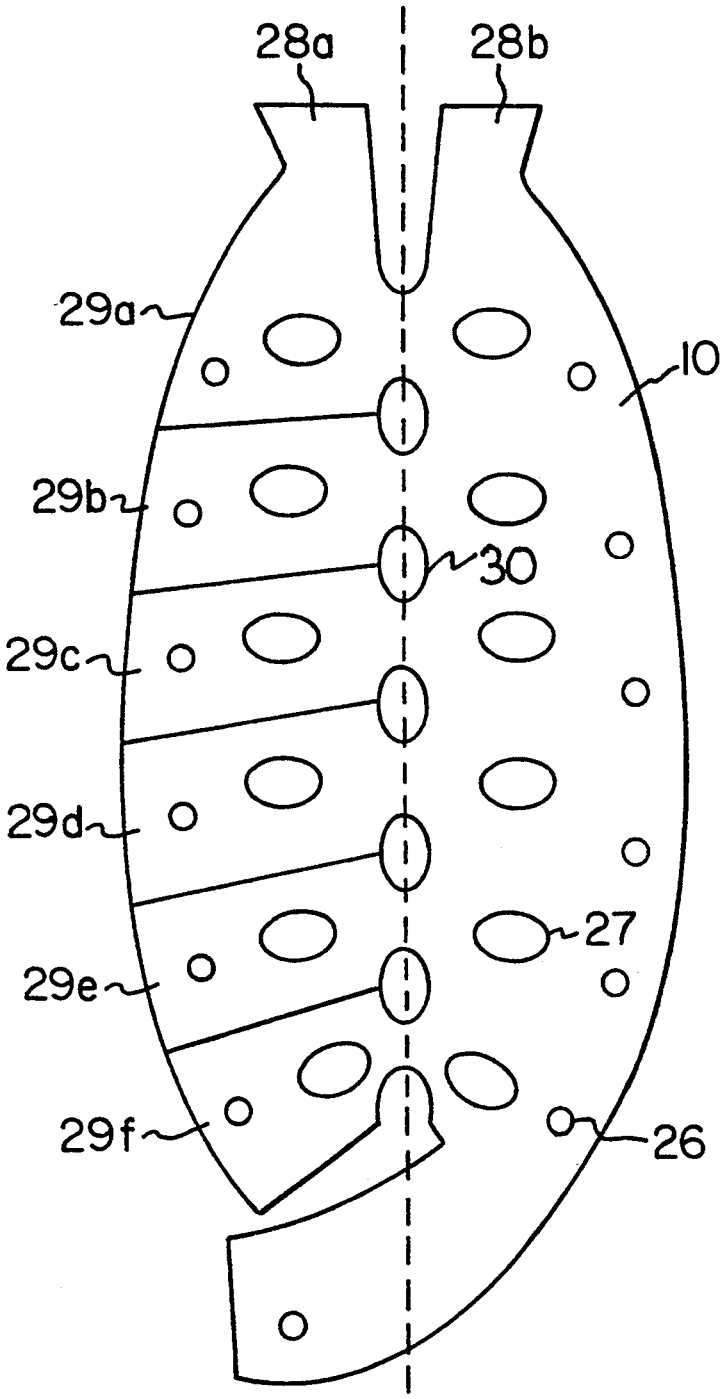
FIG. 5 is a plan view of one side of an edge piece according to the first embodiment.

Referring now to FIG. 5, there is shown an unfolded cut piece for forming one side of the U-shaped edge piece 10. The cut piece is folded along the fold line indicated on the drawing by dashed line 25. After folding, along the outer rim of the cutout are aligned lacing holes 26. Additional cutouts 27 are provided which align. The cutouts are made to provide additional flexibility to the assembled webbing. The cut piece has tabs *28a* and *28b* at the upper end which are intended for insertion in the fold of the crossbar. The inner edge of the cut piece has a series of cuts therein separating them into a series of tabs *29a* to *29f*. Each of the cuts terminates in a cutout 30 that distributes stress. After each tab has been partially inserted in a link hole 21 in the folding links, they are folded back and stitched in place.

The webbing, according to the embodiment of FIG. 1, is assembled by first placing the tabs *22a* and *22b* of the folding links into cutouts 17 provided therefor in the center web 12. Then the tabs *29a–29f* on the cut pieces which will comprise the U-shaped edge are inserted in the link holes 21 in the folding links and are folded back and stitched in place. Finally, the cross piece 11 is folded over the tabs *28a, 28b* and 16 extending from the edge piece and the center web and is stitched in place.

A material suitable for the folding links may comprise an elastic synthetic material developed by Kuraray Co., Ltd. For the production of the elastic synthetic material, superfine nylon fibers (each fiber has a thickness ranging between 1/100 to 1/500 denier) were three-dimensionally intertwined into a nonwoven fabric. Then, this nonwoven fabric was impregnated with polyurethane foam having a low elastic modulus. In the completed condition, an appropriate gap between the adjacent fibers and between the fiber and the polyurethane provides flexibility between the fibers, and the three-dimensional structure provides the fabric with flexibility and resilience in any angle. Incidentally, the nylon fiber and polyurethane foam are just examples. In the future, more appropriate elastic materials may be developed.

Figure 2:
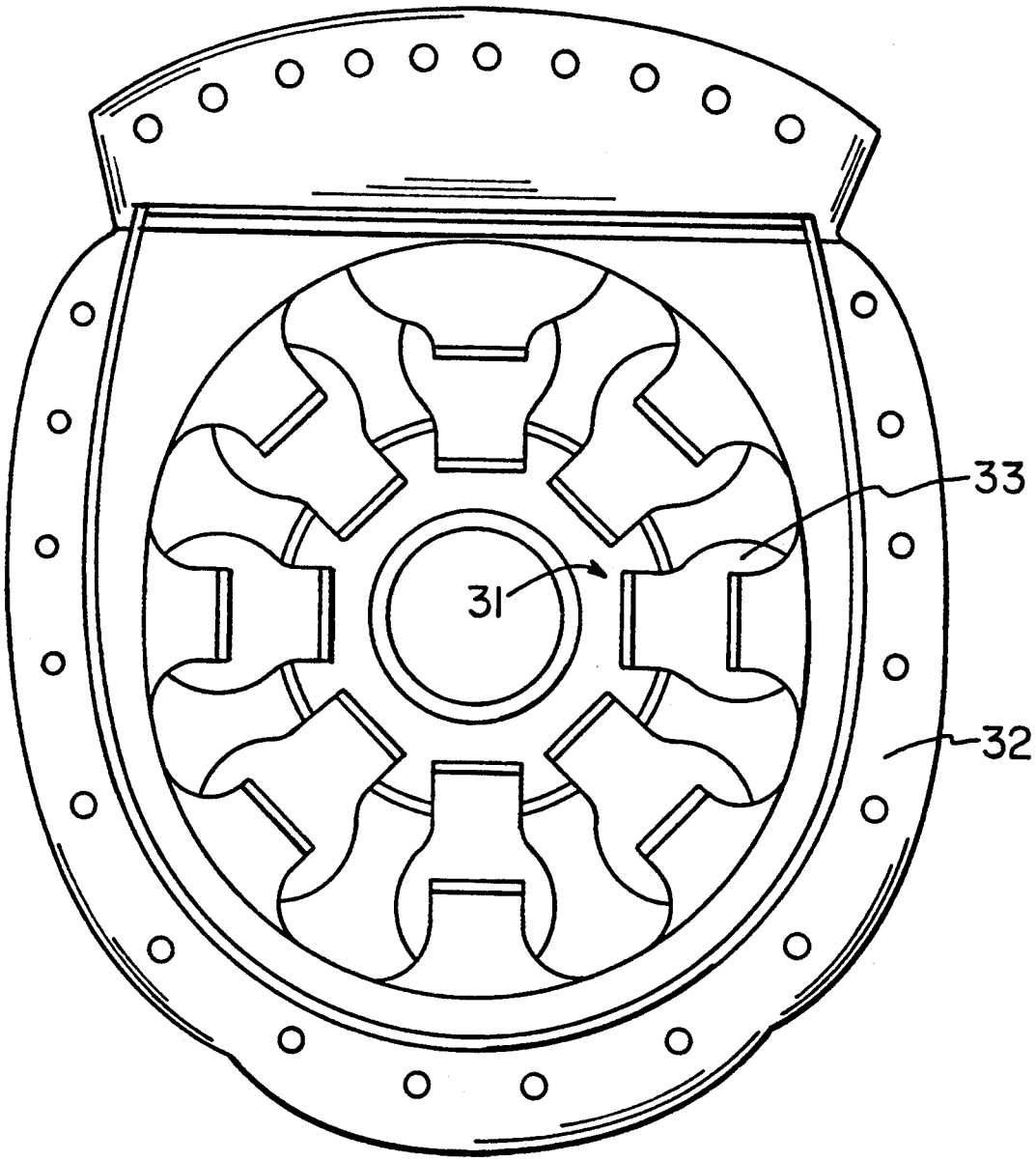
FIG. 2 is a plan view of a second embodiment according to this invention in which the center web is joined to the frame by folding links only.

Referring now to FIG. 2, there is shown another embodiment of this invention wherein the center web 31 is only connected by folding links 33 to the edge piece 32. Its construction, however, is substantially similar to the construction of the embodiment shown in FIG. 1.

Having thus defined my invention in the detail and particularity required by the Patent Laws, what is desired protected by Letters Patent is set forth in the following claims.

I claim:

1. A webbing for a ball-catching glove having separate protective coverings for the thumb and forefinger between which the webbing is laced comprising:

a) a center web comprising flexible sheet material having an outer edge defining the shape thereof and there being a plurality of link holes through the web spaced along the outer edge;

b) a plurality of folding links each comprising flexible sheet material having an outer edge defining the shape of the link, the shape of said link being substantially symmetrical about a fold line with link holes on opposite sides of the fold line which link holes align when the folding link is folded along the fold line, one of each said links being partially fitted through one of said link holes in the center web and folded so that its link holes align; and c) an edge piece comprising flexible sheet material having an outer edge defining a rim and an inner edge with a plurality of tabs extending therefrom, each tab being fitted into the aligned link holes of one of the plurality of folding links and being folded back along a fold line onto the edge piece and stitched thereto, there being a plurality of small holes along the edge of the edge piece to enable lacing of the rim to the glove.

2. The webbing according to claim 1 wherein the edge piece encloses the center web and is fastened thereto by the folding links.

3. The webbing according to claim 1 wherein the edge piece encloses the center web and is fastened thereto by stitching at least one location and by folding links at other locations.

4. The webbing according to claim 3 wherein the edge piece comprises a U-shaped section with a crossbar closing off the U-shaped section, the center web being stitched to the bottom of the U-shaped section and to the crossbar.

5. The webbing according to claim 4 wherein lacing holes are spaced across the outer edge of the crossbar and along the outer edge of the U-shaped section.

6. The webbing according to claim 1 wherein the center web comprises layers of flexible sheet material stitched together face-to-face.

7. The webbing according to claim 1 wherein the edge piece comprises flexible sheet material folded in two layers stitched together with the tabs extending from one of said folded layers prior to folding.

8. The webbing according to claim 2 wherein the center web has a substantially circular outer edge and a central opening therein.

9. The webbing according to claim 3 wherein the center web has a substantially rectangular shape with link holes along the outer edges and being fastened to the edge piece by stitching along the other two opposite outer edges.

10. The webbing according to claim 1 in which each of the link holes in the center webb has a straight edge which is substantially parallel to the edge of the center webb and which is in contact with the fold line of a folding link.

11. The webbing according to claim 1 in which each of the link holes in the folding links has a straight edge which is substantially parallel to the fold line of the folding link and which is in contact with the fold line of a tab on the edge piece.

12. The webbing according to claim 11 in which the folding links are narrowed along the fold line.

13. The webbing according to claim 1 in which the tabs on the rim are narrowed along the fold line.

14. The webbing according to claim 1 in which the link holes in the center web are large enough for the folding links to be rolled and inserted partially therethrough and the width of the links at the folding line are just less than the width of the link holes in the center web.

15. The webbing according to claim 1 in which the link holes in the folding links are large enough for the tabs to be rolled and inserted partially therethrough and the width of the tabs at the folding line are just less than the width of the link holes in the folding links.

* * * * *